United States Patent [19]

Chang

[11] Patent Number: 4,637,214

[45] Date of Patent: Jan. 20, 1987

[54] SINGLE-ENDED STEAM CHEST WITH IMPROVED SUPPORT ASSEMBLY

[75] Inventor: George W. Y. Chang, Casselberry, Fla.

[73] Assignee: Westinghouse Electric Corp., Pittsburgh, Pa.

[21] Appl. No.: 809,705

[22] Filed: Dec. 17, 1985

[51] Int. Cl.[4] ..... F01B 31/06

[52] U.S. Cl. ..... 60/687; 165/47; 415/177

[58] Field of Search ..... 60/646, 657, 687; 82/DIG. 1; 165/47, 81; 415/177, 180

[56] References Cited

U.S. PATENT DOCUMENTS

| | | | |
|---|---|---|---|
| 1,066,478 | 7/1913 | De Ferranti | 60/687 X |
| 2,376,188 | 5/1945 | Roberts | 165/47 |
| 3,147,599 | 9/1964 | Frankel | 60/687 |

*Primary Examiner*—Stephen F. Husar

*Attorney, Agent, or Firm*—R. S. Lombard

[57] ABSTRACT

A single-ended steam chest with an improved support assembly is disclosed. Inlet end flexible plates and outlet end flexible plates are affixed to the steam chest. The inlet end flexible plates are cooled while the outlet end flexible plates are heated thereby minimizing the rotation of the steam chest due to thermal expansion.

8 Claims, 13 Drawing Figures

SINGLE-ENDED STEAM CHEST WITH IMPROVED SUPPORT ASSEMBLY

BACKGROUND OF THE INVENTION

The present invention relates to a steam chest for power plants such as a fossil fired power plant and, in particular, to a single-ended steam chest with an improved support assembly. Present steam chests utilize support assemblies requiring very heavy foundation structural steels. The heavy steel support beams are expensive and must be rigidly anchored to the foundation wall which requires special consideration by foundation designers.

SUMMARY OF THE INVENTION

The present invention is in a combination with a single-ended steam chest for a power plant. The steam chest includes a hollow elongated steam chest body. The steam chest body has a steam inlet therethrough proximate the bottom portion of one end thereof. The steam chest body has steam outlets therethrough in predetermined positions. Inlet pipe means are affixed to the steam chest body proximate the steam inlet.

The present improvement comprises a support assembly means comprising inlet end flexible plate support means of predetermined dimensions. Flange member means are affixed to the inlet pipe means in predetermined position. A first base member is provided for supporting the inlet end flexible plate means. The inlet end flexible plate means are affixed at one end to the flange member means and at the other end affixed to the base member means. An outlet end flexible support plate means is affixed at the top thereof to the outlet end of the steam chest proximate the bottom portion thereof. A second base member is provided for supporting the outlet end flexible plate means. The outlet end flexible plate means is affixed at one end to the second base member and at the other end to the steam chest body. The outlet end flexible support plate means comprises a pair of first flexible parallel plate members separated from one another by a predetermined distance so as to form a heating chamber between the parallel plate members. The outlet end flexible support plate means has a length a predetermined amount greater than the inlet end flexible plate means. First insulation means is provided affixed to and enclosing the outlet end flexible plate means, whereby rotation of the steam chest axis is diminished by controlling the thermal expansion of the first inlet support plate means and the outlet end support plate means.

Preferably the inlet end flexible support plate means comprises a plurality of inlet flexible plate means disposed at right angles in the vertical plane around the circumference of the inlet pipe in predetermined position.

For severe transient conditions the inlet end flexible plate means each comprises a pair of second flexible parallel plate members of equal dimensions and disposed opposite one another thereby forming a cooling chamber therebetween. The inlet end flexible plate means desirably has cooling air inlet means passing therethrough proximate the bottom thereof and cooling air outlet means passing therethrough proximate the top thereof. The inlet end preferably further comprises first end plates affixed to the pair of second parallel plates to enclose the cooling chamber.

The outlet end flexible plate preferably has heating air inlets passing therethrough proximate the bottom thereof and heating air outlets passing therethrough proximate the top thereof. Preferably the outlet end flexible plate means further comprises flow deflectors disposed in predetermined position within the heating chamber. Preferably the outlet end flexible plate means further comprises second end plate means affixed to the pair of first flexible parallel plate members to enclose the heating chamber.

BRIEF DESCRIPTION OF THE DRAWINGS

For a better understanding of the invention, reference may be had to the accompanying drawings, in which.

DESCRIPTION OF THE PREFERRED EMBODIMENT

Figure 2:
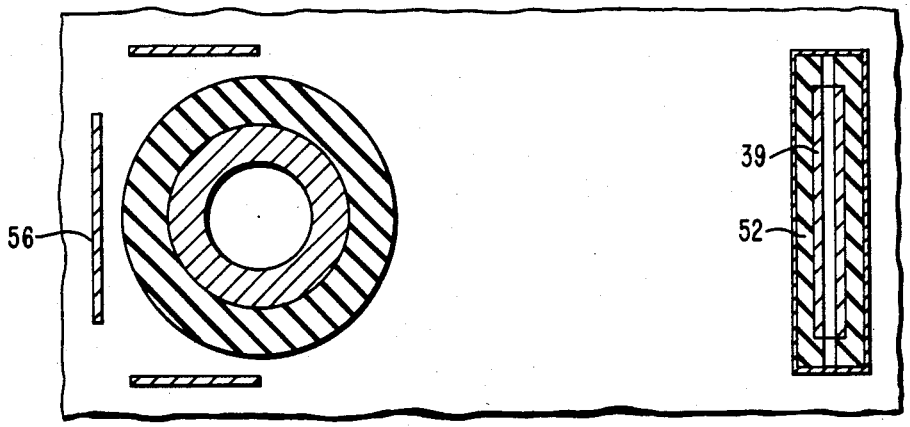
FIG. 2 is a cross-sectional view taken along the line II—II of FIG. 1.
Figure 1:
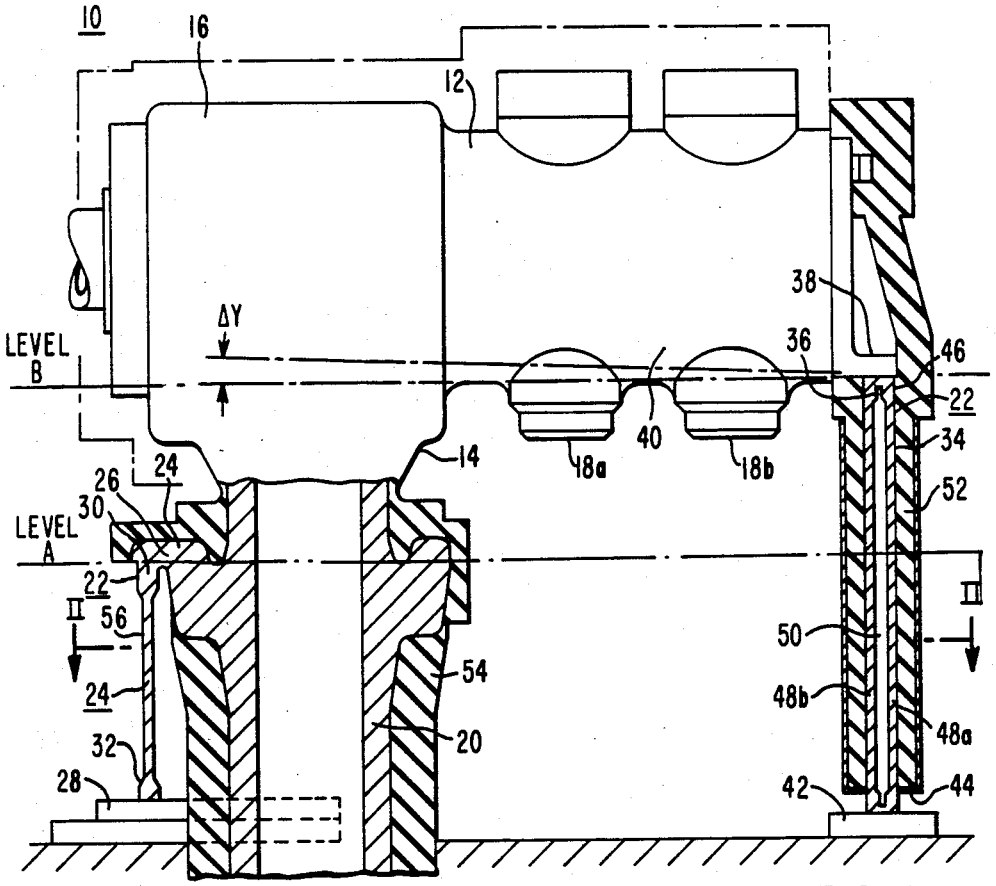
FIG. 1 is a side elevational view of a singleended steam chest wherein the inlet flexible plate means consists of a single plate and the outlet end flexible support plate means includes a pair of first flexible parallel plate members.
Figure 4:
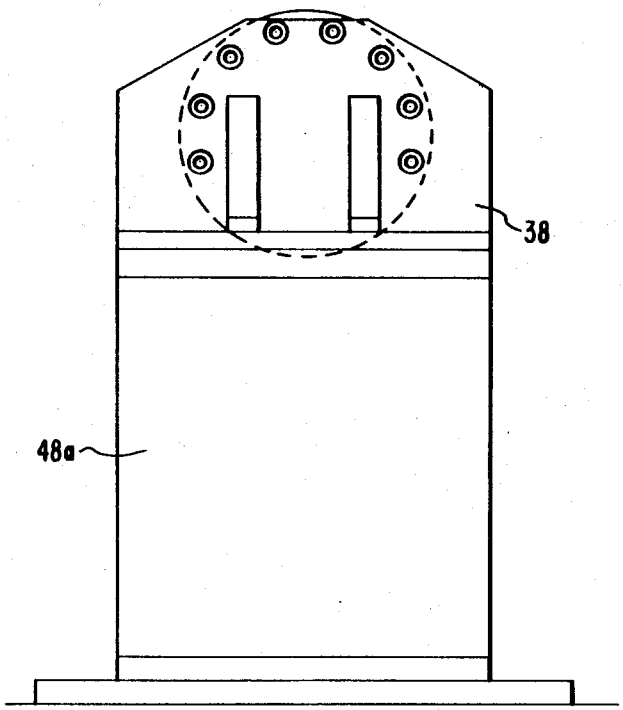
FIG. 4 is an end elevational view of the outlet end flexible plate means shown in FIG. 3.
Figure 3:
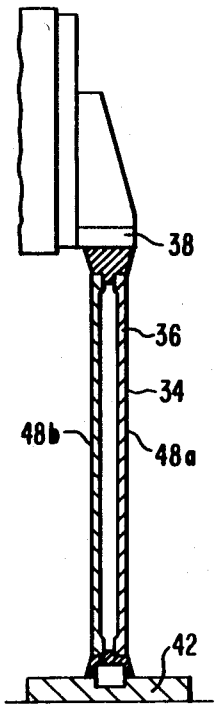
FIG. 3 is a side elevational view of the outlet end flexible plate means.
Figure 7:
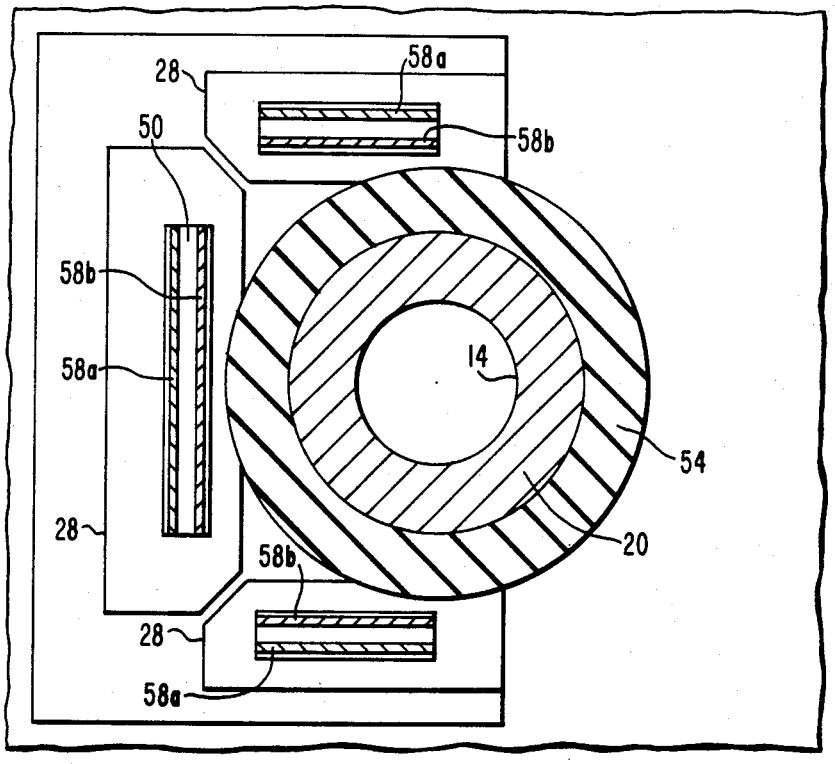
FIG. 7 is a plan view of a portion of the inlet end flexible plate means taken along line VII—VII of FIG. 5.
Figure 5:
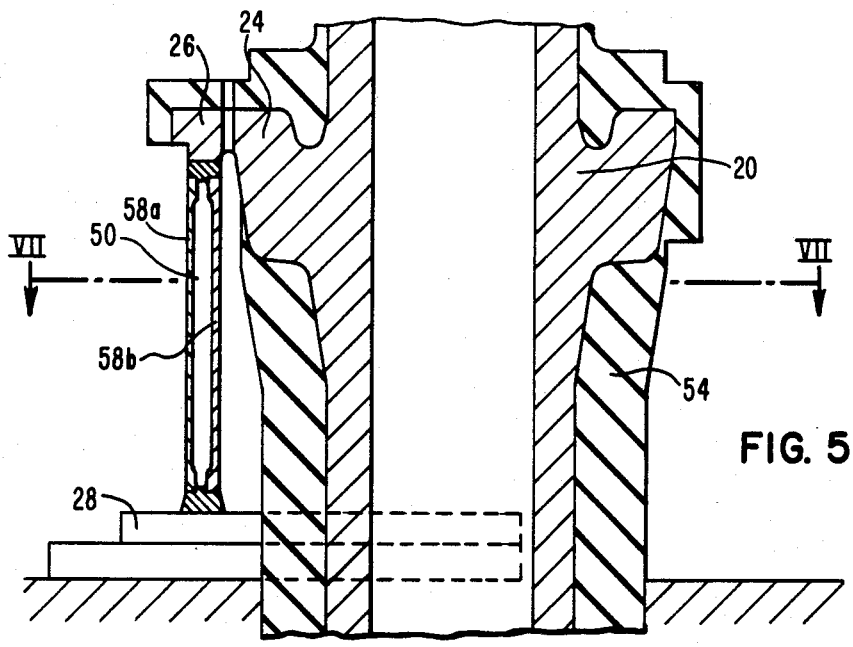
FIG. 5 is a side elevational view of a single-ended steam chest wherein the inlet end flexible plate means each includes a pair of second flexible parallel plate means and showing the position of insulation to be used.
Figure 6:
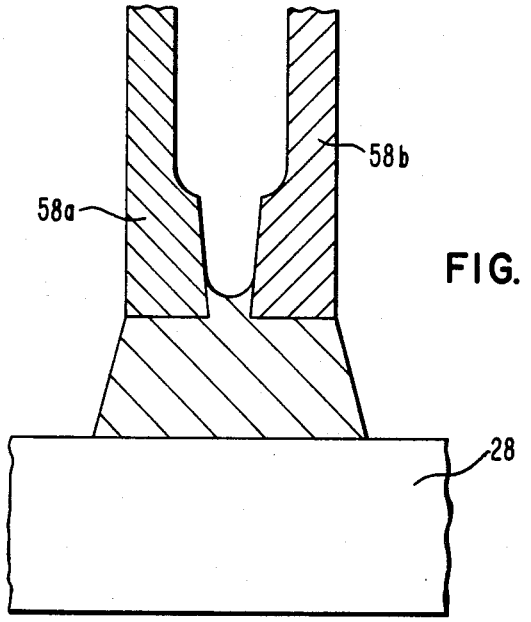
FIG. 6 is an enlarged sectional view of a portion of the inlet end flexible plate means shown in FIG. 5.

Referring to FIGS. 1 and 2, there is provided a single-ended steam chest 10 for a power plant. The term "single-ended" applies to a steam chest provided with one steam inlet. The steam chest 10 includes a hollow elongated steam chest body 12. The steam chest body 12 has a steam inlet 14 passing therethrough proximate the bottom portion of one end 16 thereof. The steam chest body 12 has steam outlets **18*a*, 18*b* passing therethrough in predetermined position as shown in FIG. 1. Inlet pipe means 20 is affixed to the steam chest body 12 proximate the steam inlet 14. The single-ended steam chest 10** as described thus far is conventional.

The improvement comprises support assembly means 22 comprising inlet end flexible plate support means 24 of predetermined dimensions such as 30×25×0.62 inches. Flange member means 26 is affixed to the inlet pipe 20 in predetermined position as shown in FIG. 1.

A first base member 28 is provided for supporting the inlet end flexible plate 24. The inlet end flexible plate means is affixed at one end 30 to the flange members 26 and the inlet end flexible plate 24 at the other end 32 is affixed to the base member means 28.

The support assembly means 22 also includes outlet end flexible support plate means 34 is provided. The outlet end flexible support plate means 34 is affixed at the top 36 thereof to the outlet end 38 of the steam chest body 12 proximate the bottom portion 40 thereof.

A second base member means 42 is provided for supporting the outlet end flexible plate means 34. The outlet end flexible plate means 34 is affixed at one end 44 to the second base member means 42 and at the other end 46 to the steam chest body 12.

The outlet end flexible support plate means 34 comprises a pair of first flexible parallel plate members 48*a*, 48*b*. The first flexible parallel plate members 48*a*, 48*b* are separated from one another by a predetermined distance such as 1.5 inches so as to form a heating chamber 50 between them. The outlet end flexible support plate means 34 has a length, such as 57 inches, a predetermined amount greater than the inlet end flexible plate means 24. First insulation means 52 is affixed to and encloses the outlet end flexible plate means 34 and second insulation means 54 is affixed to and encloses the inlet pipe 20. The first and second insulation means may be fiberglass sheets, such as manufactured by Pittsburgh Corning Corporation.

Preferably the inlet end flexible support plate means 24 comprises a plurality of inlet flexible plate members 56 disposed at right angle in the vertical plane around the inlet pipe 20 in predetermined position such as shown in FIG. 2. Utilizing the present invention, the rotation of the axis of the steam chest body 12 is diminished by controlling the thermal expansion of the first inlet end flexible support plate means 24 and the outlet end flexible support plate means 34. With reference to FIG. 1, the region between elevations marked level "A" and level "B", the outlet end flexible plate 34 receives heat from the steam chest body 12 by heat conduction and is cooler than the steam chest inlet 14 in this region. Therefore, thermal expansion vertically from the foundation floor up to level "B" is less at the outlet end flexible support plate means 34 than at the inlet end flexible support plate means 24. This differential thermal expansion indicated by "$\Delta Y$" is reduced by heating the outlet end flexible support plate 34 and cooling the inlet end flexible support plate means 24. The outlet end flexible support plate 34 is insulated externally along its entire length to improve heating from the steam chest body, while the inlet end flexible support plate means 24 is ventilated. This provides for reduction of the differential thermal expansion "$\Delta Y$" to satisfactory levels.

Figure 8:
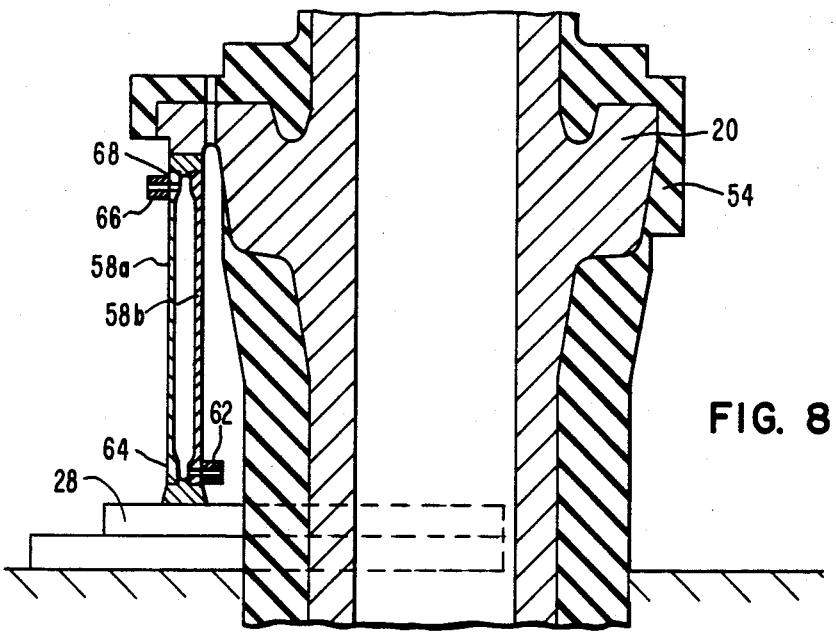
FIG. 8 is a side elevational view of the inlet end portion of the single-ended steam chest showing the cooling air inlet and outlet passing through the inlet end flexible plate means.
Figure 9C:
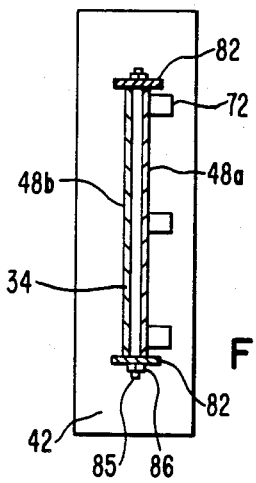
FIG. 9C is a sectional view of the outlet end flexible plate means taken along line IXC—IXC of FIG. 9A.
Figure 9A:
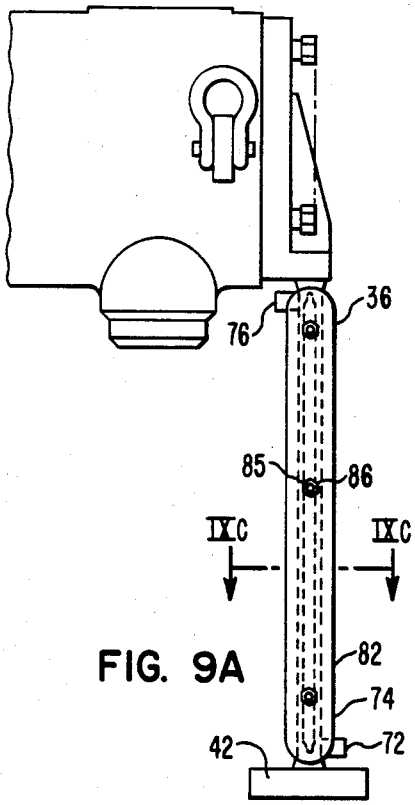
FIG. 9A is a side elevational view of the outlet end portion of the single-ended steam chest showing heating air inlet and outlet and end plates affixed to the first flexible parallel plate members.
Figure 10:
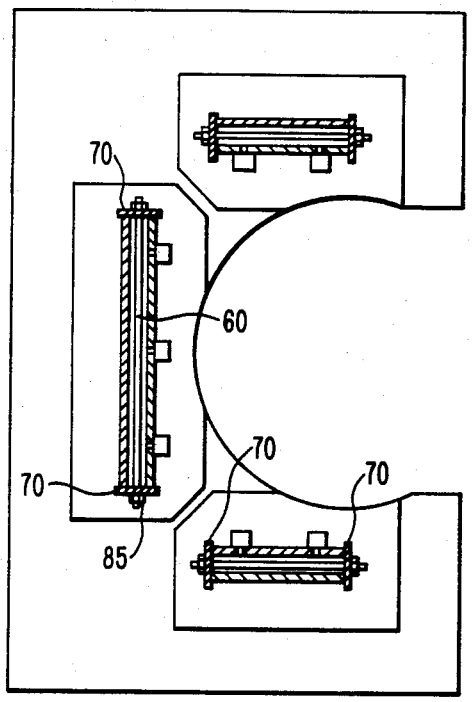
FIG. 10 is a plan view of the inlet end flexible plate means shown in FIG. 8.

The foregoing embodiment should prove satisfactory for most operating conditions. However, for extremely severe transient operations where further heat equalization is desired, the following embodiments may be utilized. Preferably, each of the inlet end flexible support plate means comprises a pair of second flexible parallel plate members 58*a*, 58*b* of substantially equal dimension such as $37\times36\times0.75$ inches and disposed opposite one another thereby forming a cooling chamber 60 therebetween as shown in FIGS. 5–8. Preferably the inlet end flexible plate means 24 has cooling air inlet means 62 passing therethrough proximate the bottom 64 thereof and cooling air outlet means 66 passing therethrough proximate the top 68 as shown in FIG. 8. The cooling air inlet and outlet means 62, 66 may be bosses having a one inch diameter hole therethrough. The inlet end flexible plate means 56 may further comprise first end plate means 70 to enclose the cooling chamber 60 as shown in FIG. 10. The outlet end flexible plate means 34 preferably has heating air inlet means 72 passing therethrough proximate the bottom 74 and heating air outlet means 76 passing therethrough proximate the top 36 thereof as shown in FIG. 9A. The heating air inlet 72 and the heating air outlet 76 may be bosses having a one inch diameter hole therethrough, for example.

Figure 9B:
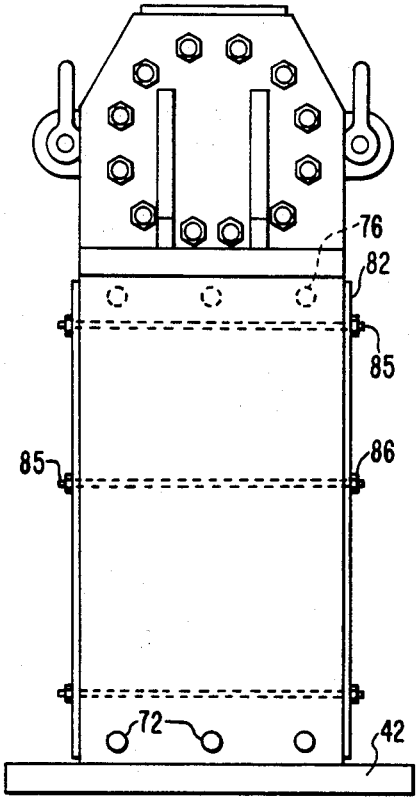
FIG. 9B is an end elevational view of that shown in FIG. 9A.
Figure 11:
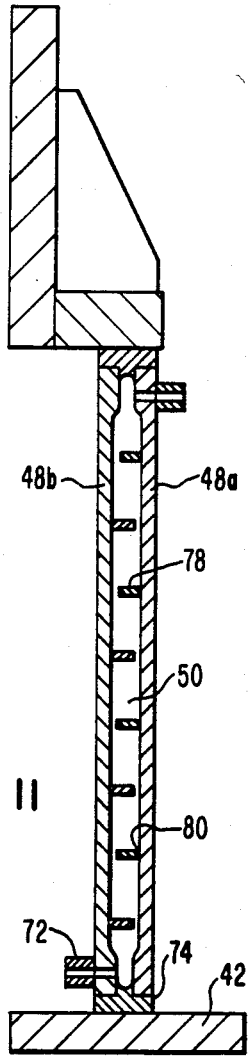
FIG. 11 is an elevational view of the outlet end flexible plate means including flow deflector means.

Preferably flow deflector means 78 is disposed in predetermined position within the heating chamber 50 as shown in FIG. 11. The flow deflectors comprise a plurality of plates 80 affixed alternately to opposite first flexible parallel plate members 48*a*, 48*b*. Preferably the outlet end flexible plate means 34 further comprises second end plate means 82 affixed to the pair of first flexible parallel plate members 48*a*, 48*b* to enclose the heating chamber 50 as shown in FIGS. 9A–9C. The first and second end plate means 70, 82 may be affixed by the use of tie rods 85 and nuts 86. Three outlet bosses 76 are attached near the top of the outlet end flexible plate means 34. The inlet end flexible plate means 58 are cooled by air in a similar manner as the outlet end flexible plate means is heated by high temperature air. The inlet bosses connect to cooling air boses.

What is claimed is:

1. In combination with a single-ended steam chest for a power plant, said steam chest including a hollow elongated steam chest body, said steam chest body having a steam inlet therethrough proximate the bottom portion of one end thereof, said steam chest body having steam outlets therethrough in predetermined position, inlet pipe means affixed to said steam chest body proximate said steam inlet, the improvement which comprises support assembly means comprising inlet end flexible plate support means of predetermined dimensions, flange member means affixed to said inlet pipe means in predetermined position, a first base member means for supporting said inlet end flexible plate means, said inlet end flexible plate means affixed at one end to said flange member means and at the other end affixed to said base member means, outlet end flexible support plate means affixed at the top thereof to the outlet end of said steam chest body proximate the bottom portion thereof, a second base member means for supporting said outlet end flexible plate means, said outlet end flexible plate means affixed at one end to said second base member means and at the other end to said steam chest body, said outlet end flexible support plate means comprising a pair of first flexible parallel plate members separated from one another by a predetermined distance so as to form a heating chamber between said first parallel plate members, said outlet end flexible support plate means having a length a predetermined amount greater than said inlet end flexible plate means, first insulation means affixed to and enclosing said outlet end flexible plate means, second insulation means is affixed to and encloses the inlet pipe whereby axial rotation of said steam chest body is diminished by controlling the thermal expansion of said first inlet end flexible support plate means and said outlet end flexible support plate means.

2. The steam chest of claim 1, wherein said inlet end flexible support plate means comprises a plurality of inlet flexible plate members disposed at right angles in the vertical plane around said inlet pipe in predetermined position.

3. The steam chest of claim 1, wherein each of said inlet flexible plate means comprises a pair of second flexible parallel plate members of equal dimensions and disposed opposite one another thereby forming a cooling chamber therebetween.

4. The steam chest of claim 3, wherein said inlet end flexible plate means has cooling air inlet means passing therethrough proximate the bottom thereof and cooling air outlet means passing therethrough proximate the top thereof.

5. The steam chest of claim 4, wherein said inlet end flexible plate means further comprises first end plate means affixed to said pair of second flexible parallel plate members to enclose said cooling chamber.

6. The steam chest of claim 1, wherein said outlet end flexible plate means has heating air inlet means passing therethrough proximate the bottom thereof and heating air outlet means passing therethrough proximate the top thereof.

7. The steam chest of claim 6, wherein said outlet end flexible plate means further comprises flow deflector means disposed in predetermined position within said heating chamber.

8. The steam chest of claim 6, wherein said outlet end flexible plate means further comprises second end plate means affixed to said pair of first flexible parallel plate members to enclose said heating chamber.

* * * * *